United States Patent [19]

Eberius et al.

[11] 4,034,034

[45] July 5, 1977

[54] PROCESS FOR MELT-SPINNING FILAMENTS FROM NOZZLES COATED WITH STABILIZED SILICONE OIL

[75] Inventors: Wiprecht Eberius, Kreuzau; Herbert Lorenz, Laudenbach, both of Germany

[73] Assignee: Akzona Incorporated, Asheville, N.C.

[22] Filed: Oct. 15, 1974

[21] Appl. No.: 515,049

[30] Foreign Application Priority Data

Oct. 15, 1973 Germany ..... 2351668

[52] U.S. Cl. ..... 264/39; 264/169

[51] Int. Cl.[2] ..... D01D 1/10

[58] Field of Search ..... 260/46.5 G, 45.75 R; 264/176 F, 169, 39

[56] References Cited

UNITED STATES PATENTS

| | | | |
|---|---|---|---|
| 2,465,296 | 3/1949 | Swiss | 174/121 |
| 3,130,449 | 4/1964 | Demas et al. | 264/176 F |
| 3,188,239 | 6/1965 | Klapper | 264/39 |

*Primary Examiner*—Jay H. Woo

*Attorney, Agent, or Firm*—Keil, Thompson & Shurtleff

[57] ABSTRACT

A process for melt-spinning a synthetic linear fiber-forming polymer into filaments by extrusion through a nozzle or so-called nozzle plate treated on its discharge face with a thin layer silicone oil coating wherein said coating is stabilized with a cerium compound. The stabilizing composition or additive preferably consists essentially of the reaction product of a cerium compound with a polymethylsiloxane bearing reactive hydrogen atoms.

5 Claims, No Drawings

PROCESS FOR MELT-SPINNING FILAMENTS FROM NOZZLES COATED WITH STABILIZED SILICONE OIL

The present invention relates to a process for the production of filaments, threads, yarns or the like of linear, fiber-forming, synthetic thermoplastic polymers according to the well known melt-spinning method wherein the spinning nozzle is coated with a silicone oil, i.e. a liquid polyorganosiloxane, on the discharge face of the nozzle.

It is known in the commercial production of synthetic polymer filaments according to the melt-spinning method that the polymer melt must be extruded through nozzles or so-called nozzle plates containing at least one and usually many spinning bores or orifices. The polymer melt is fed to the spinning nozzle under considerable pressure, for example as applied by a feed means such as a screw extruder. Upon exiting the nozzle orifices or openings, the polymer melt in the form of hot freshly spun filaments enters the so-called blowing or spinning shaft which is ordinarily maintained at about atmospheric pressure. At the exit or discharge opening of the spinning nozzle, disturbances occur frequently. The so-called balloon effect is a common disturbance whereby the individual filaments inflate like balloons immediately upon leaving the nozzle due to the sudden drop in pressure. This balloon effect causes irregularities in the filament or yarn size, and it can also cause uneven dyeing or coloration.

The so-called "dripping" at the filament exit opening of the nozzle is also a very serious problem because it may force the immediate stoppage of the spinning process from that particular nozzle. The formation of such drops of the molten polymer occurs because the filament, instead of exiting vertically, issues diagonally so as to cause tensions or stresses in the filament at the nozzle exit and to bring about a swinging or oscillating movement of the filament. Such movement may then cause the filament to hit the nozzle surface next to the exit opening so that the filament usually breaks instantly. A drop is then formed at the nozzle opening which can quickly spread over the discharge face to the other nozzle openings. Even without this spreading to other openings, the formation of such a drop causes a spinning disruption which must be eliminated. Aside from the time loss incurred by these disruptions, they also tend to increase the number of so-called "short bobbins", i.e. incompletely wound bobbins of the spun filaments to be used for further processing. This is of a great disadvantage because the textile industry attempts to use the largest possible size bobbins or feed spools containing a single, flawless thread or yarn, i.e. a thread without knots or other serious flaws.

Finally, deposits or encrustations easily form at the exit openings of the nozzles which may diminish the size of any individual opening to the point that it becomes impossible to extrude the required amount of polymer melt through the nozzle opening within a given unit of time. A deviating size of the filament, thread or yarn results from a gradual change in filament diameter, i.e. even if there is no breakage of individual filaments.

Efforts have been made to alleviate the above mentioned disadvantages by coating the metallic spinning nozzles at the exit openings, i.e. over the discharge face of the nozzle plate, with a heat-resistant organic silicon compound which is preferably sprayed onto the nozzle in a thin layer (see German Pat. No. 837,436). However, it was found that these organic silicon compounds were not sufficiently stable with respect to the specific conditions prevalent at the exit opening of a spinning nozzle. The polymer melt as it is spun must be maintained at relatively high temperatures above at least 270° C and usually well in excess of 290° C. Such high temperatures are also observed at the discharge face of the spinning nozzle. It was also found that the thin layer coatings of such silicon compounds, e.g. silicones, could not be maintained without damage during the periodical cleaning of the disassembled or disengaged nozzle plate.

However, literature directed to a method for the stabilization of silicones does exist. For example, U.S. Pat. No. 2,445,567 describes the stabilizing of silicones, especially liquid organo-substituted polysiloxanes by incorporating therein a salt of iron, cobalt, nickel or copper. Silicone oils when thus modified are not sufficiently stable under melt-spinning conditions. Therefore, such liquid silicones containing these metal salts are not very practical as a means of coating spinning nozzles in the melt-spinning of synthetic filaments. Even these stabilized silicones show a marked decomposition on the nozzle plate during the course of the spinning process, thereby causing a build up of undesirable solid deposits which disturb or disrupt the continuous extrusion of the filaments.

Without sufficient stabilization, there is also the danger of a volatilization of the silicone oil coating through an oxidizing degradation of the polysiloxane chain. In addition, the use of metal compounds can lead to a discloration of the spun filaments since particles of the silicone film or coating is continuously carried off by the filaments from the nozzle. Silicone oils stabilized by iron compounds appear opaque or cloudy and of a brownish color even prior to their application onto the nozzle plate or exposed face of a spinneret. After melt spinning proceeds, the high temperatures and presence of oxygen may cause even further discoloration as well as solid deposits.

For these and other reasons, the use of an unstabilized silicone oil has been preferred up to the present time for the coating of spinning nozzles. Silicones which contain at least some phenyl groups were primarily used as being more resistant to high spinning temperatures. However, even these silicones revealed a number of disadvantages due to the fact that these phenyl-substituted siloxanes evaporate in a comparatively short period of time under the conditions of the melt-spinning process, thus causing the nozzles to run dry and to begin to drip. The nozzle is ordinarily sprayed with the silicone oil during the continuous spinning process and is then cleaned later. The primary cleaning procedure in this case is the so-called "scraping" technique whereby the nozzle face is stripped or shaved with a sharp, even instrument, for example a knife-like device such as a blade, scraper or the like in order to remove the polymer deposits from the discharge face of the nozzle.

It is a common practice to scrape or strip the nozzle periodically, regardless of whether the nozzle drips or not. This commonly called a scraping routine. Such maintenance is of course very tedious and requires a considerable amount of manpower. The only result of this routine procedure is merely the fact that, instead of unpredictable spinning disruptions, there are introduced regular or planned disruptions. This routine cleaning process, however, only partly prevents unpredictable spinning disruptions such as dripping. There are still disruptions of individual nozzles in any multi-unit spinning operation requiring a large number of spinning heads equipped with a corresponding large number of spinnerets or nozzles. Individual units or nozzles require a so-called intermin scraping between the planned or routine periodical scrapings. The use of phenyl-substituted silicone oils for the lubrication of spinning nozzles has an added disadvantage in that these oils spread very poorly, i.e. they do not distribute themselves upon the nozzle surface. Therefore, an even distribution on the nozzle plate with such oils is difficult. There is also the risk that parts of the nozzle plate are not reached at all by this oil or that those parts which have the greatest need for oil often dry out immediately. These silicone oils are therefore not particularly useful for continuous spinning operations. These disadvantages are especially pronounced with large nozzle plates, e.g. spinnerets having a large number of spinning orifices.

These known silicone oils also have the tendency to attract or hold solid deposits or particles at high temperatures, e.g. decomposed polymers and the like. This causes a soiling of the nozzle plates during the scraping process, i.e. so that the nozzle plates cannot be kept clean.

It is an object of the present invention to overcome the disadvantages commonly known from the use of silicone oils on spinning nozzles by using a cerium stabilizing agent in relatively small stabilizng amounts together with any readily available silicone oil. Other objects and advantages of the invention are explained in detail in the following disclosure.

It has now been found, in accordance with the invention that filaments of synthetic polymers can be extruded or spun through a spinning nozzle or spinneret which has been treated on its discharge or exit face with a thin layer silicone oil coating in an especially advantageous manner if the silicone oil is stabilized with a small stabilizing amount of a cerium compound. Silicone oils stabilized with a cerium compound and having a viscosity of about 50 to 600 centipoises have been found to be very suitable, viscosities of about 70 to 300 centipoises being especially advantageous. A liquid polydimethyl siloxane is the preferred silicone oil for coating spinning nozzles.

In an especially advantageous embodiment of the process of the invention, a silicone oil thin film coating is stabilized by the use of the reaction product of cerium acetyl acetonate with a polysiloxane containing reactive hydrogen atoms.

The term "silicones" is used with reference to the present invention to correspond to the so-called organo-siloxanes, as defined in Römpp Chemie-Lexikon, 1966 edition, page 5934 ff. These substances may also be defined as "organo-polysiloxanes" or "polyorganosiloxanes" depending upon one's preference in nomenclature. The term "silicone oils" is restricted to those organo-siloxanes which are liquid under normal conditions. In this specification, the viscosity of such liquid silicones is given as the absolute viscosity in centipoises (cp.) at 20° C.

One preferably uses linear polymers with oxygen and silicon atoms alternating in a chain and the lateral valences of the silicon atoms being predominantly saturated with hydrocarbon substituents. Silicone oils of a relatively fluid consistency, at least not so viscous as to prevent easy application, are most suitable for the process of this invention. Silicone oils with a viscosity of approximately 50–600 cp. are especially useful.

Preference is given in this invention to the use of methyl silicones, i.e. those polymethylsiloxanes with the lateral valences of the silicon atoms as well as their terminal valences being completely or at least predominantly saturated with methyl groups. However, silicones may be used which contain other hydrocarbon substituents, especially those in which at least some of the methyl groups are substituted by phenyl groups. Also, it is not absolutely required that the silicones being used have a linear structure.

In those instances where the lateral or terminal valences of the silicon atoms are not completely or predominantly saturated with methyl groups, phenylated silicones containing a degree of phenylation of up to 25%, preferably up to 3%, have proven to be very suitable. The degree of phenylation indicates the percentage of the total silicon valences which are substituted by phenyl groups. For example, a 3% phenylated polydimethylsiloxane is one in which 3% of the methyl groups are replaced by phenyl.

In one particular version of the process of the invention, a mixture of the polymethylsiloxane and 3% phenylated derivative has been used with advantage. Application of such mixture to the spinning nozzles gives especially favorable cleaning results because a good separation of deposits from the metallic nozzle face can be achieved as well as a cleansing and dissolving effect.

For the stabilization of the silicone oil, a variety of cerium compounds may be used within the scope of this invention. Purely inorganic compounds yielding a cerium ion may be used, especially cerium nitrate or cerium sulfate as the most readily available cerium salts. Salts of organic acids are also suitable, including those organic carboxylic acids identified in the above noted U.S. Pat. No. 2,445,567 at column 3, line 63, to column 4, line 17, in connection with other metals. The lower molecular weight alkanoic acid salts of cerium are especially preferred in this class of organic salts, e.g. up to about 12 carbon atoms, including both straight and branched chain acids. The initial source of the salt or other compound of cerium is not of exceptional importance provided that the cerium is in a relatively soluble cationic form when finally dispersed in the silicone oil. A stabilizing reaction can then occur with the silicone oil in situ.

The amount of cerium, calculated as the metal required as a stabilizer is usually at least about 0.001% with reference to the weight of the silicone oil being stabilized and usually not more than 0.5% by weight. Good results are obtained where the content of cerium is about 0.005 to 0.2% by weight and especially about 0.01–0.1% by weight.

Cerium compounds with a chelate structure, e.g. as obtained with diketones and especially the acetylacetonate of cerium, are very suitable as a stabilizing additive. Such chelating compounds as acetylacetone are comparable to carboxylic acids in terms of acid strength and may be regarded as providing equivalent cerium salts, e.g. as represented by cerium acetylacetonate of the formula $Ce(CH_3COCHCOCH_3)_3$.

Within the scope of this invention, a cerium-containing silicone is particularly suitable when obtained as the reaction product of cerium acetylacetonate and a siloxane containing a reactive hydrogen atom. Silicones with reactive hydrogen atoms are compounds in which lateral or terminal valences of the silicon atoms are not saturated by alkyl or phenyl or other organic groups but still contain hydrogen atoms. These hydrogen atoms are extremely reactive. In the reaction with the cerium compound, the cerium becomes chemically bound to the silicon compound. This reaction, which takes place in the presence of molecular oxygen, has been assumed to lead to a product in which the cerium is connected covalently with the silicone molecule by means of an oxygen atom, i.e. replacing the active hydrogen atoms. This chemical compound, which can be identified by its cerium content, is very effective as a stabilizer within the scope of this invention because it regenerates itself during the use of the thin layer silicone oil on the spinning nozzles in the presence of sufficient oxygen from the air. This self-regenerating cerium siloxane shows a stabilizing effect of long duration. Silicone oils stabilized in this manner are very homogenous, do not tend to form solid deposits and are practically colorless even at the high temperatures required for spinning nozzles.

A silicone oil stabilized with a cerium compound according to the invention can be easily applied to the conventional nozzles used in the melt-spinning process. For example, the stabilized liquid silicone preparation can be applied to the nozzle with a suitable brush prior to the spinning process. The stabilized silicone oil can also be sprayed onto the nozzle discharge face by using a convenient pressure device, e.g. such as an aerosol can or similar pressurized container. It can also be applied, however, according to the atomizer principle. The nozzles can be advantageously treated prior to each scraping or cleaning procedure. The process and stabilizing agent of the invention have a number of surprising advantages. Silicone oils stabilized with a cerium compound spread very easily on the exit side or exposed surface of the spinning nozzle, thus forming a uniform thin film. After being sprayed onto the nozzle, for example, the oil moves quickly towards the nozzle openings, i.e. directly around the spinning orifices where the oil is consumed during the spinning process. The nozzle can operate considerably longer than it could when treated with unstabilized silicones, for example even with silicone stabilized in some manner other than with a cerium compound. Because of the use of cerium as the essential stabilizer, the use of the conventional methyl silicones (polydimethylsiloxanes) is improved because these methyl silicones by themselves form an even thin layer film but then decompose very quickly without good stabilization, thereby leading to operational malfunctions during filament spinning. With the cerium stabilized silicone oil, practically no spots occur on the nozzle face where there is no silicone oil present, and the formation of decomposition products on the nozzle is considerably reduced compared to the use of an unstabilized oil.

The number of interim scrapings required to considerably reduced by the process of the invention using the essential stabilizing agent. The result is a cleaner scraping than would be the case if the usual scraping agents were applied. The stabilized silicone oil of the invention clearly proves to be an especially effective lubricant for the scraping process, as well as an extremely effective separating agent which prevents the adherence of deposits on the nozzle plate. It is also possible to considerably increase the intervals between the routine or periodic scraping operations. Heavier or higher tare weight bobbins (wound spools) can be manufactured because the usual interim scrapings can be substantially reduced to permit longer continuous spinning runs with a uniform yarn size.

The invention has proven particularly advantageous in the production of fine individual filament sizes according to the melt-spinning process. The difficulty of producing finer filament sizes without incurring frequent spinning malfunctions is common knowledge, and such malfunctions are normally impossible to avoid in the manufacture of so-called fine to finest titers. The present invention overcomes this problem to a very appreciable extent even in the manufacture of such fine and finest filament sizes.

The invention is further exemplified as follows:

EXAMPLE

In an Erlenmeyer flask of 1 liter capacity, 6.51 grams of cerium nitrate and 4.5 grams of acetylacetone are dissolved in 300 ml. of distilled water. A 2% ammonium solution is added in drops, shaking vigorously, until a pH value of exactly 8.0 is achieved. This results in a light yellow precipitate of cerium acetylacetonemonohydrate, identified by the formula $Ce(CH_3COCHCOCH_3)_3 \cdot H_2O$ which is suctioned off by a Buechner funnel and rinsed with 300 ml. of distilled water. The precipitate is dried under high vacuum without heating until a dust-like or pulverulent product is obtained.

4.10 grams of the cerium acetylacetonemonohydrate are heated in 2.5 liters of distilled benzene for 5–10 minutes under reflux, while an airstream is introduced into the solution at a rate of 5 liters/minute. To the resulting dark red solution, there is added a mixture of 100 ml. benzene containing 6.25 grams of a siloxane having a reactive hydrogen atom, and the mixture is then heated for one hour under reflux while further introducing 5 liters/minute of air. Then 5 kg. of the silicone oil to be stabilized are added and the benzene is distilled off under constant introduction of 15 liters of air per minute. The internal temperature of the mixture is increased to 275° C., the amount of air is increased to 80–100 liters/minute, and then heating is continued for another 4 hours at 275° C. internal temperature.

The silicone oil stabilized in this manner has a good natural color and is completely transparent. With this silicone oil, stabilized as above, the nozzles of melt-spinning apparatus are covered with a thin layer silicone film by spraying. Nozzles with this stabilized silicone film or coating are then used to produce profiled nylon 6 (polycaprolactam) filaments with a size of 17 dtex. With a time interval of 8 hours in the routine scraping procedure, only 0.83 additional interim scrapings are needed per 12 spinning positions per day. If a typical unstabilized commercial silicone is used for coating the nozzles, 5.36 interim scrapings are needed under otherwise identical conditions.

The preparation of the silicones required for this invention is well described in the prior art, usually beginning with organochlorosilanes as the monomeric intermediates obtained, for example, by reacting methyl chloride with powdered silicon at an elevated temperature and with a catalyst to form the silanes. Both the silicone oils and the polysiloxanes containing reactive hydrogen atoms, as used in the present invention, may be defined as being siloxane polymers with the recurring unit of the formula

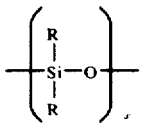

(I), where R may represent hydrogen, alkyl, halo-substituted alkyl, phenyl, halo-substituted phenyl or similar non-reactive organic radicals up to about 12 carbon atoms and $x$ is a whole integer sufficiently large to provide a polymer with the above noted fluid viscosities. Preferred alkyl groups are those of about 1 to 4 carbon atoms, especially methyl. Preferred halogen substituents are F, Cl and Br, especially chlorine or fluorine as in the commonly used trifluoropropyl substituent. In the silicone oils, R preferably does not represent hydrogen, the term "reactive hydrogen atom" being restricted to those siloxanes, preferably the polymethylsiloxanes, used for reaction with the cerium compound to provide a composition which is especially useful as a stabilizing agent or additive which can then be incorporated in small amounts in any of the silicone oils applied as a coating on spinning nozzles. This stabilizing additive may therefore be represented by the formula

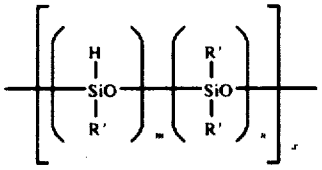

(II), wherein R' may be any non-reactive organic radical up to about 12 carbon atoms but is preferably limited to lower alkyl, phenyl and trifluoropropyl as the most readily available substituents. It is especially advantageous to use those polysiloxanes in which R' is methyl or at least consists essentially of methyl, e.g. 90–95% or more of these substituents being methyl. The number of reactive hydrogen atoms is preferably less than about half the number of silicon atoms, i.e. $m$ and $n$ are whole integers with m being equal to or less than n, it being understood that the terminal siloxane groups of the polymer may also contain a reactive hydrogen atom or may be saturated, i.e. substituted, by a non-reactive organic radical such as methyl.

Again, it is emphasized that especially good results have been achieved by using polymethylsiloxanes which in their fully saturated form have the structural formula

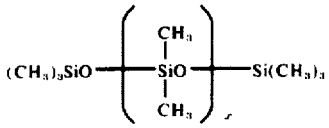

(III)

Replacement of up to about 10% of the methyl groups with phenyl groups yields an especially useful phenylated silicone oil for coating spinning nozzles, it being understood that $x$ is a whole integer as defined above to provide a viscosity in the ranges given, i.e. about 50–600 cp. and especially about 70–300 cp. In one particular embodiment of the invention, a mixture is used by combining the polydimethylsiloxane of the formula (III) with its phenylated derivative. This combination of two different polysiloxanes not only functions well during spinning but also facilitates the scraping and cleaning operations such that polymer deposits on the nozzles are more effectively removed.

The preparation of the cerium-containing silicone is carried out as in the preceding example in the presence of oxygen to yield the reaction product of cerium compound, particularly a salt of an organic acid or its equivalent chelate, with a silicone or polysiloxane containing reactive hydrogen atoms. This initial reaction product as the stabilizer requires only moderately elevated temperatures, e.g. slightly above room temperature but preferably above about 60° C., the rate of reaction increasing with increasing temperature and with more intimate contact with oxygen or air. Once the cerium silicone product is obtained in this manner, it is preferably admixed with the silicone oil to be stabilized and heated in contact with air or oxygen at about the temperatures to be anticipated on the spinning nozzles or slightly higher, e.g. in a range of 200°–350° C., preferably about 250°–300° C.

Other specific examples of stabilizers and silicone oils used on spinning nozzles are as follows:

| starting Ce-compound | Ce in % added as $Ce(acac)_3 \cdot H_2O$ | degree of phenylation of stabilized silicone oil in mol % |
|---|---|---|
| $Ce(NO_3)_3 \cdot 6\ H_2O$ | 0.025 | — |
| $Ce_2(SO_4)_3 \cdot 4\ H_2O$ | 0.1 | 3 |
| $Ce(NO_3)_3 \cdot 6\ H_2O$ | 0.005 | 25 |
| $CeCl_3 \cdot 7\ H_2O$ | 0.01 | 10 |

The invention is hereby claimed as follows:

1. In a process for melt-spinning a synthetic linear fiber-forming polymer at temperatures of at least about 270° C. into filaments by extrusion through a nozzle treated on its discharge face with a thin layer silicone oil coating, the improvement of using a silicone oil coating stabilized with a small stabilizing amount of a cerium compound consisting essentially of the reaction product of cerium acetylacetonate and a polymethylsiloxane containing reactive hydrogen atoms.

2. A process as claimed in claim 1 wherein the silicone oil has a viscosity of about 50 to 600 centipoises.

3. A process as claimed in claim 1 wherein the silicone oil has a viscosity of about 70 to 300 centipoises.

4. A process as claimed in claim 1 wherein the silicone oil being stabilized is a polydimethylsiloxane.

5. A process as claimed in claim 1 wherein the silicone oil being stabilized is a polydimethylsiloxane in which up to of the methyl groups are replaced by phenyl.

* * * * *